US007096512B2

(12) United States Patent
Blair

(10) Patent No.: US 7,096,512 B2
(45) Date of Patent: Aug. 29, 2006

(54) PROTECTIVE SPORTS HAT INSERT DEVICE

(76) Inventor: Mary Lynne Blair, 18 Reliance Court, Scarborough, Queensland (AU) 4020

( * ) Notice: Subject to any disclaimer, the term of this patent is extended or adjusted under 35 U.S.C. 154(b) by 107 days.

(21) Appl. No.: 10/398,590

(22) PCT Filed: Oct. 8, 2001

(86) PCT No.: PCT/AU01/01259

§ 371 (c)(1),
(2), (4) Date: Apr. 3, 2003

(87) PCT Pub. No.: WO02/28211

PCT Pub. Date: Apr. 11, 2002

(65) Prior Publication Data

US 2004/0034903 A1 Feb. 26, 2004

(30) Foreign Application Priority Data

Oct. 6, 2000 (AU) ..... PR0606

(51) Int. Cl.
*A42B 1/06* (2006.01)

(52) U.S. Cl. ..... 2/410; 2/425
(58) Field of Classification Search ..... 2/409–412, 2/414, 425
See application file for complete search history.

(56) References Cited

U.S. PATENT DOCUMENTS 3,935,044 A * 1/1976 Daly ..... 156/79
4,439,871 A 4/1984 Plastino
4,575,871 A 3/1986 Auerbach et al.
5,226,180 A 7/1993 Leach
5,269,026 A 12/1993 McManus
5,289,591 A 3/1994 Andersen
5,313,668 A 5/1994 Bogan et al.
5,437,064 A * 8/1995 Hamaguchi ..... 2/414

(Continued)

FOREIGN PATENT DOCUMENTS

WO WO 90/06698 6/1990

*Primary Examiner*—Katherine M. Moran
(74) *Attorney, Agent, or Firm*—Straub & Pokotylo; Michael P. Straub

(57) ABSTRACT

A protective sports hat insert device is disclosed. The device is a moulded compound insert utilizing reinforced fibres as the preferred embodiment as the outer shell or unreinforced fibres as secondary choice (18) (41*a*) (41*b*) (48*a*) (48*b*) (55*a*) (55*b*) with either a flexible inner shell or a rigid inner shell (19) (42*a*) (42*b*) (49*a*) 49*b*) 56*a*) (56*b*) utilizing high-density foam or an air management system with slits or holes (4*a*) (4*b*) punctured along the top. The shells are hemispherical and have a removable cloth liner (20) (43*a*) (43*b*) (50*a*) (50*b*) (57*a*) (57*b*) to add comfort. Resilient spacers (7*b*) provide comfort and a better fit. A retention strap (25*a*) (32) (33) secures the device to the head. An identification decal (25*e*) denotes the hat is a safety-approved device and visibly identifies the wearer for safety from oncoming traffic. When the outer insert shells (18) (41*a*) (41*b*) (48*a*) (48*b*) (55*a*) (55*b*) and the inner shells (19) (42*a*) (42*b*) (49*a*) (49*b*) (56*a*) (56*b*) along with the cloth liner (20) (43*a*) (43*b*) (50*a*) (50*b*) (57*a*) (57*b*) are placed inside an existing hat (15*a* & 15*aa*) (15*b* & 15*bb*) (15*c* & 15*cc*) (38*a*) (38*b*) (45*a*) (45*b*) (52*a*) (52*b*) some extra protection and comfort will be provided to the head while maintaining the outward appearance of an existing sports hat (15*a* & 15*aa*) (15*b* & 15*bb*) (15*c* & 15*cc*) (38*a*) (38*b*) (45*a*) (45*b*) (52*a*) (52*b*).

23 Claims, 6 Drawing Sheets

U.S. PATENT DOCUMENTS 5,519,895 A * 5/1996 Barnes, Jr. ..... 2/422
5,657,492 A * 8/1997 Esposito, Jr. ..... 2/410
5,737,777 A * 4/1998 Hilleary ..... 2/421
5,898,949 A * 5/1999 Barthold et al. ..... 2/416
6,012,172 A 1/2000 Steffy
6,154,889 A * 12/2000 Moore et al. ..... 2/418
6,401,258 B1 * 6/2002 Wilson ..... 2/410
6,467,099 B1 * 10/2002 Dennis et al. ..... 2/455

* cited by examiner

PROTECTIVE SPORTS HAT INSERT DEVICE

FIELD OF THE INVENTION

This invention relates to a device for providing some protection to the head of the wearer of a hat, while the wearer is taking part in sporting activities. In one aspect, the device is particularly for protecting the wearer when a flying object, such as a golf ball or baseball, soccer ball or other flying object strikes the wearer's head (scenario 1). In a second aspect, the device is for protecting the wearer's head in collision with the ground or other object (scenario 2), such as when the wearer is roller blading, skate boarding, snow boarding, skiing, or cycling.

BACKGROUND OF THE INVENTION

In the first aspect, the possibility of being hit on the head while golfing, playing baseball, or while spectating is a concern. At present, baseball/golf caps offer little protection for the head from flying balls. Although previous inventions and designs have proposed rigid plastic and foam inserts for hats such as those described in U.S. Pat. Nos. 4,439,871, 5,226,180, 5,289,591, 5,269,026 the protection offered is not varied and thorough protection and it is unclear whether they meet safety guidelines and these devices have not been a commercial success. The amount of actual protection afforded against a flying golf ball is also questionable.

In the second aspect where a person may fall or collide with another person or object while snowboarding, skate boarding, cycling, horse riding or the like is also a major concern. Head injuries often result from such falls or collisions. At present there are protective helmets that some people wear whilst carrying out such activities, while many prefer to wear a less cumbersome sports hat, especially on the ski slopes. Existing helmets can be hot and uncomfortable and they can put undue stress on the delicate neck muscles because they are heavy and cumbersome which may contribute to broken necks in some accidents where the wearer is involved in a collision. With many existing helmets the wearer's sense of hearing is impaired and this can cause anxiety and a lack of communication, which could lead to danger. Aesthetically, many people also prefer to wear their favorite hats instead of a cumbersome helmet.

This is particularly the case with "the youth market" i.e. teenagers and younger adults. In some states and counties, such as New South Wales, Australia, despite the legal requirement to wear a helmet, many bike riders particularly teenagers, do not wear helmets partly because they can be hot and sweaty to wear but also because they are perceived to be "uncool", particularly, in comparison with "cool" headgear such as beanies, toques, baseball caps and the like. Teenage cyclists may often be seen riding their bicycles, carrying their protective helmet on the handle bar of the bike, and wearing a baseball cap. The latter, of course, provides no collision protection for the wearer. Children and teenagers riding popular mini scooters also tend to wear only a baseball cap rather than a protective helmet.

There have been many protective headgear suggestions in the past. For example, U.S. Pat. No. 4,439,871 (referred to above) to Plastino, discloses a protective insert comprising a single shell consisting of a rigid unreinforced plastic, which is relatively heavy and has poor shock absorption properties. Plastino discloses an inner circular foam piece for the top of the head, however, the sides, front and back of the head lack the second layer allowing less protection to the head. An adjustable sweatband is disclosed which adjusts to various head sizes and absorbs sweat along the lower edges. The design suggested by Plastino is manifestly "uncool" to the "youth market" and the protection afforded the wearer's head dubious in both aspects of protecting against impacts against objects and protecting the wearer's head when struck with, e.g. a golf ball. When testing prototypes with ballistic golf ball testing equipment at the Institute of Preventative Sports Medicine in Ann Arbor, Mich., the sides and the top of the head required extra shock absorbing protection which Plastino's model lacks.

U.S. Pat. No. 5,226,180 to Leach also listed above, discloses protective headgear in the form of a hemispherical-shaped shell composed of a rigid Styrofoam material attached, either permanently or temporarily to an outer cover by a suitable adhesive. The Styrofoam would have to be very thick to absorb shocks and function effectively and it would be difficult to maintain the outer appearance of a regular sports cap with this proposal. This Styrofoam material would allow penetration by a flying object thus it would be for single use only.

U.S. Pat. No. 5,481,759 to Rinaldi discloses a rigid shell with a skirting material to tighten and fasten the shell on the outside of the shell and a rigid bill/visor removable from the shell.

U.S. Pat. No. 5,289,591 to Anderson discloses a rigid plastic shell with many ventilation holes and a cutout section to fit inside an adjustable exterior baseball cap. The shell is unlikely to provide any real protection in either scenario 1 or scenario2, and also looks uncomfortable to wear.

U.S. Pat. No. 5,269,026 to McManus discloses a safety liner, which is adjustable and only partially encircles the head.

In the inventor's prior Australian Patent Application No. 52761/98, a protective insert discloses a single layer plastic shell which lacks the necessary inner shock absorbing layer required to protect the entire head from impact in standardized tests. The present invention discloses both an inner and outer shell that has passed Australian/New Zealand Standardized Impact Tests for cycling at Imtest Laboratory in Christchurch, New Zealand. When a single layer shell was tested, it could not pass the impact testing.

None of the foregoing designs are believed to have passed or be capable of passing the standardized tests for protective headgear. The above referenced patents, advocate the use of either a rigid unreinforced plastic as an insert, which is heavy and provides little inert shock absorption protection to the entire head or a single shell of rigid foam such as in U.S. Pat. No. 5,226,180 which is bulky and for single use only as it becomes dented and cracked upon a substantial impact.

In other prior art relating to military and other helmets such as GB 2,202,729 to Shephard and Tobin, the use of aramids in many layers (about twenty-five layers) is disclosed to protect against bullets. GB 1,578,351 and 1,578,352 to Lovell discloses the use of aramid in many layers (about twenty-five layers) for use in heavier ballistic bulletproof helmets. Such bulletproof helmets are thick, heavy, and clearly far too cumbersome for wearing inside a hat for sports such as golf or cycling.

It is an object of the present invention to address the problems of the existing protection devices as are described above, and provide a protective insert which provides suitable protection to the wearer but which also can fit inside a wearer's sports cap or the like to maintain a pleasing aesthetic appearance.

Regarding the cloth liner for a hat or hat insert, there have been many cloth liner suggestions in the past. For example, W.O. Pat. No. 90/06698 to Weyerhaeuser Company discloses a disposable liner of liquid permeable material that has an elongated body and covers the lower portion of the hat to add comfort to the forehead.

U.S. Pat. No. 5,313,668 to Bogan discloses a liner for a hat consisting of a moisture absorbent material that is backed by a layer of moisture impervious material. The device is essentially a headband strip section and does not cover the entire head.

AU Pat. Application No. 45826/96 to Schlink discloses a single layer absorbent liner for a hat or cap.

DE 29915233 U1 to Kassing discloses a single layer liner that includes a lower sweatband portion as well as a crown portion.

In the inventor's prior Australian Patent Application No. 52761/98, is a removable cloth sleeve, similar to a pillowcase that covers both the exterior and interior sides of the shell. The cloth liner of the present invention only lines the inside of the shell where it is useful to absorb the sweat and provide comfort without adding any bulky unnecessary covering of the outside of the shell.

The cloth liner of the present invention discloses a moisture absorbent layer backed by a moisture resistant layer that covers the entire head area inside a hat, rather than a restricted sweatband area or single layer liner. The present invention can be easily removed for laundering and used more economically than the disposable liners disclosed in previous inventions. The previous inventions are for either single layer liners or liners that only partially cover the head area inside a hat or hat insert.

The double layer liner can be folded into a compact moisture resistant bag to be attached to sporting equipment or clothing to be used as an exchangeable liner as required as when the existing liner becomes sweaty and uncomfortable. The Velcro® dots or strips on the exterior of the bag can be mated to Velcro® dots or strips placed on the handlebars of the cycle or scooter. As another temporary attachment method for snowboarders, skiers, or golfers the folded cloth liner bag could use a releasable clasp mechanism to attach the bag to a zipper or ring on the ski jacket or golf bag.

SUMMARY OF THE INVENTION

According to the present invention, there is provided a device for insertion into a sports hat or the like comprising:

a solid outer shell;

an inner layer of foam material, the insert being sized and shaped for insertion into a typical sports cap such as a baseball cap or the like; and a washable double layer cloth liner to provide comfort to the wearer and to extend the life of the hat.

The outer shell of the present invention uses as the preferred embodiment the use of reinforced fibres such as aramid (trade names of Kevlar® or Twaron®) or polyethylene (trade names of Spectra® or Dyneema®), which is lightweight and has natural shock absorbing properties or rigid unreinforced plastic could be substituted as a heavier and less expensive alternative. The inner layer is composed of high-density foamed plastic such as expanded polystyrene (EPS) or an adaptive energy absorbing liner, such as a liner using technology referred to as Air Management System (AMS), that provides an adaptive, energy absorbing layer which includes a plurality of air filled cells joined together by fluid flow passageways, so as to establish an intercommunicating structure which provides effective cushioning. The cells also include pressure responsive seals, which restrict fluid flow between the cells when the cells are subjected to a mechanical force above a pre-selected level. Closure of the seals converts the material from open cell, to a closed cell structure, allowing it to absorb and dissipate high levels of kinetic energy.

In tests of inserts embodying the present invention the inner shock absorbing layer covering the entire head has proved an essential feature when standardized tests were conducted. Ballistic golf ball testing equipment used at the laboratory for the Institute of Preventative Sports Medicine in Ann Arbor, Mich., USA showed there was little difference in protection with a single layer outer shell and a bare head form showing there was not enough shock absorption to prevent injury with a single shell. The two layer shells as consisting of an outer thin aramid layer and a liner using AMS, performed well with these initial tests using the ballistic golf ball test equipment at the Institute. It is believed that the synergistic combination of the rigid outer layer and framed inner layer, covering the top, front and sides of the head provides the requisite protection. Standardized tests for the cycling impact test according to Australian Standards conducted at Imtest Laboratory in Christchurch, New Zealand provided results, which also showed that a single layer shell did not provide sufficient shock absorption properties to the head. The prototypes as described in the present invention passed the shock absorption requirements for cycling according to Australian/New Zealand Standards when tested at Imtest Laboratory.

Thus the present invention provides a composite insert having a protective shell having a shock absorbing inner layer which together combine to provide sufficient protection for Scenario 1 or Scenario 2 and are relatively comfortable to wear and can also be fitted inside headgear such as baseball caps which are more likely to be worn by eg the youth market or by golfers who do not wish to look out of the ordinary on a golf course by wearing a cumbersome protective helmet. The present invention is lightweight and absorbs sweat for comfort.

Instead of expanded polystyrene (EPS) the inner layer might be HPDE (high density polyethylene), expanded polypropylene (EPP), vinyl nitril, an air management system (AMS), or the like.

It is preferred that spacers are provided on the inside of the inner foam layer.

The inner layer may be lined with a removable moisture absorbent and moisture resistant cloth liner.

An optional removable retention strap in the case of the first scenario may be provided—attached to the outer shell, and a compulsory permanently attached retention strap in the case of the second scenario.

A luminescent or highly legible emblem decal with an approval symbol helps to identify the wearer as a safety feature and helpful for law enforcers to identify that the attractive hat covers an approved headgear apparatus.

A colored stripe or symbol may be embedded on or in the outer shell during manufacturing to identify the sport for which the insert is certified.

In one particular preferred form of the invention, the outer shell is a thin lining made from a moulded compound utilizing reinforced fibres such as aramid or polyethylene most preferably a single or double layer or at most about five layers being used. This is made lightweight yet provides some protection from an impact.

In another form of the invention, the outer shell uses a rigid unreinforced plastic as a cheaper but heavier alternative as the outer shell.

In another form of the invention the inner layer comprises a flexible circular and wedge-shaped section of high density foam, such as EPP, HPDE, EPS, vinyl nitril or a liner using an Air Management System or the like folded inside the outer shell to form an inner hemispherical shell to provide shock absorption to the head. Alternatively, the flexible high-density foam or AMS may also be moulded into the hemispherical shell if desired.

In another option for the inner shell is a moulded rigid high-density expanded plastic foam such as EPS, HPDE, EPP, or the like, shaped in a hemispherical shell to provide the wearer with the added protection. In this embodiment, it is particularly advantageous if the inner shell is tapered along the lower edge. Although the material is bulky, this tapering allows the inner layer to fit inside the hat and in this way the outward aesthetic appearance of the hat remains the same. There is no compromise on safety since in the standardized test results for protection, as prototypes with inner shells as described above passed the impact tests.

In another preferred form of the invention, spacer strips are attached to the inner bottom sides of the inner layer to provide cushioning and comfort to the head preferably with the option of choosing various sizes to allow a better fit and ventilation.

Preferably, a removable double-layer cloth liner may be attached to provide either a cooling effect or a warming effect, providing comfort in the respective environments. The outer washable layer may be made of any moisture resistant material to keep the inner washable moisture absorbent layer dry when folded into the compact bag. The inner washable liner may be made of any washable absorbent material, such as polyester-cotton to help alleviate possible sweat or a wool blend to provide a warming effect. Slits or holes in the form of buttonholes or the like can be sewn along the top of the double layer liner to line up with the holes in the shells to allow ventilation if desired. The inner moisture absorbent layer is slightly shorter than the outer moisture resistant layer to allow a neat finish as the outer layer is folded over and sewn or fused together. A small zipper is sewn along the lower front edge of the double layer to be opened when used inside the shells and closed when folded into the compact moisture resistant bag. Any other means of temporary closure of the bag may be used such as the use of mating "hook" and "loop" strips or dots marketed under the trade name Velcro®. The liner is easily removed for laundering. As the cloth liner fits only on the inside of the insert device, the outer appearance of the sports hat remains the same. The device can be carried as a spare moisture resistant liner when folded and attached to the handlebars, ski jacket, or golf bag to be readily available as a replacement.

In another form of the invention, the means of temporary attachment are provided to allow ease in removal of the cloth liner from the inner shell as with the use of mating "hook" and "loop" dots marketed under the trade name Velcro®) or other temporary means of attachment.

In another form of the invention, a retention strap must be permanently attached to the device on at least one side of the outer shell and must be secured to the head in the second scenario in accordance with the standardized test requirements for the respective countries. The prototype of the present invention passed the Australia/New Zealand Standardized retention strap requirements for pedal cycling when used according to the permanent rivet and mating snap attachment model embodying to the present invention described below.

In another form of the invention, a cloth cover in any desirable color or pattern can be wrapped over the retention strap with mating Velcro® dots or with any other temporary means of attachment as an optional aesthetic aid in complementing the hat with the retention strap. Strips of material may be attached as a less cumbersome aesthetic aid.

In another form of the invention, an optional removable snap cover may be snapped over the existing snap attachment as an aesthetic aid.

BRIEF DESCRIPTION OF A PREFERRED EMBODIMENT

Figure 1:
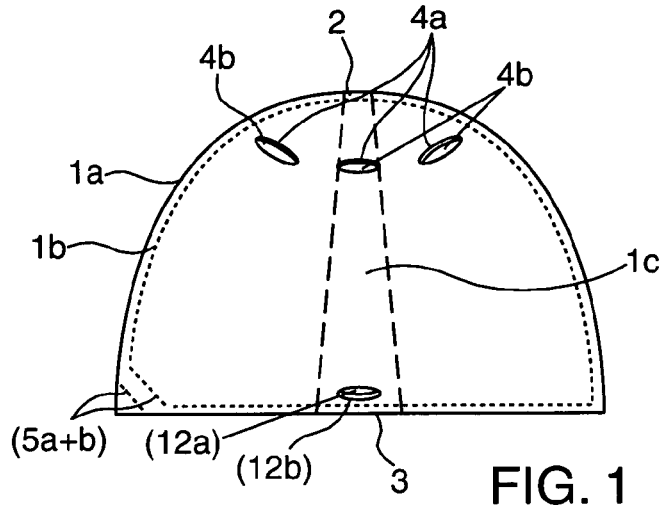
FIG. 1: Shows one embodiment of a protective sports hat insert outer shell composed of a moulded compound shell of reinforced fibres or plastic with an embedded colored stripe and inner flexible or rigid section of high-density foam or AMS hemispherical shaped with holes or slits punctured.
Figure 4A:
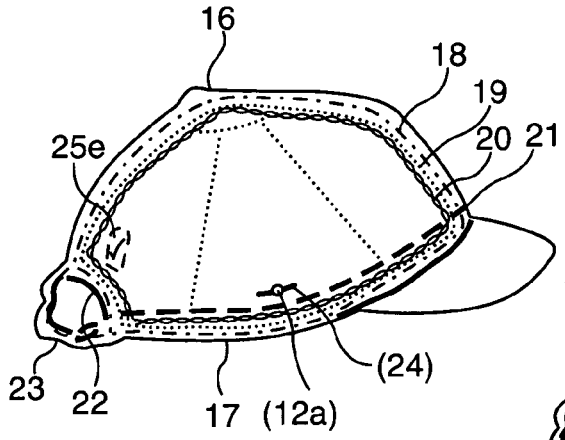
FIG. 4*a*: Shows one embodiment of a protective sports hat insert device in operation, featuring an expandable baseball cap style with the flexible inner shell and cloth liner with the expandable back.
Figure 4B:
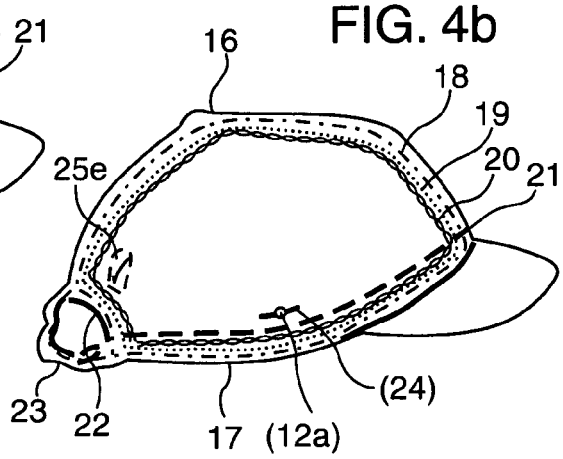
FIG. 4*b*: Shows one embodiment of a protective sports hat insert device in operation, featuring an expandable baseball cap style with the rigid moulded inner shell and cloth liner with the expandable back.

Referring to the drawings, FIG. 1 shows a protective sports hat insert device comprising the outer shell 1*a* composed of a moulded compound material utilizing reinforced fibres such as an aramid (Kevlar® or Twaron®) or polyethylene (Spectra® or Dyneema®) or unreinforced plastic. The inner shell 1*b* is composed of high-density foam or AMS to allow extra shock absorption. Slits or holes 4*a*&*b* have been punctured through the shells 1*a*, 1*b* to allow air circulation. An optional indent 5*a*&*b* can be made in the case of the expandable style of baseball cap see FIGS. 4*a*, 4*b* with the indented cloth 5*c*, 5*d* and indented compound insert 5*a*, 5*b* fitting into the indented section of the cap 22 (FIGS. 4*a*, 4*b*). There is a visible color-coded stripe 1*c* embedded or embossed on the outer shell. Inserts for different sports certification have different colored stripes. Alternatively, a symbol representing the sport could be embedded in or printed on the shell. An optional snap 12*a* can be inserted into the inside or outside of the outer shell in the case of adding the optional retention strap 25 as shown in FIG. 7*b*. The mating snap 27 can be attached to snap 12*a* to secure the device to the head. A buttonhole in the hat 24 can be made to attach the retention strap to the outside of the hat if desired.

Figure 2A:
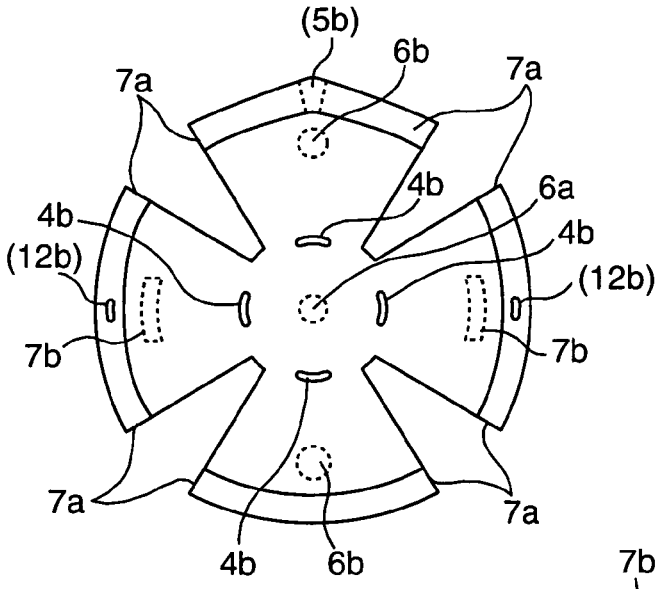
FIG. 2*a*: Shows one embodiment of a flexible, circular shapped multiwedge-shaped-section of high-density foam with ventilation holes, Velcro® dots, spacer strips, and tapered edges.
Figure 2B:
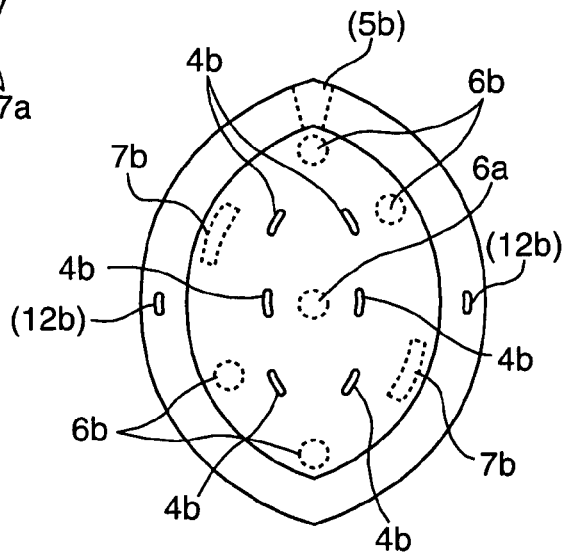
FIG. 2*b*: Shows one embodiment of a hemispherical liner composed of rigid or flexible high-density foam or AMS with ventilation holes, Velcro® dots, spacer strips, and tapered edges.
Figure 5A:
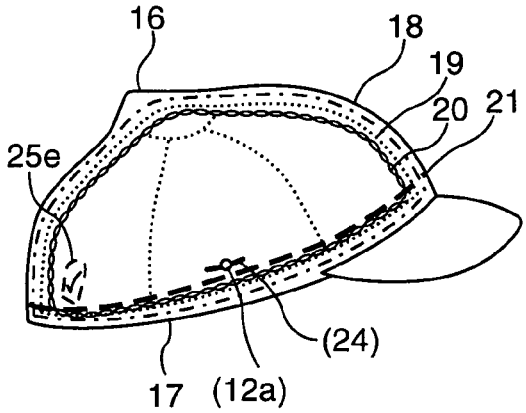
FIG. 5*a*: Shows one embodiment of a protective sports hat insert device in operation, featuring a fitted baseball cap style with the flexible inner shell and cloth liner.
Figure 5B:
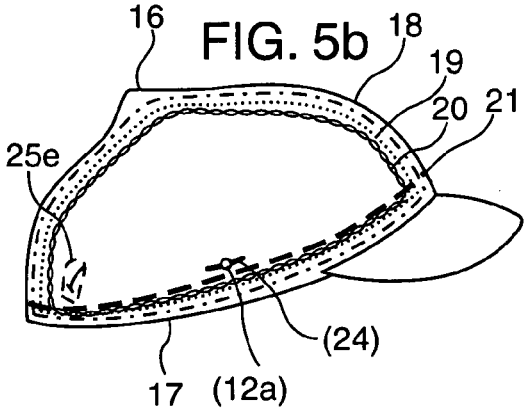
FIG. 5*b*: Shows one embodiment of a protective sports hat insert device in operation, featuring a fitted baseball cap style with the rigid moulded inner shell and cloth liner.
Figure 6A:
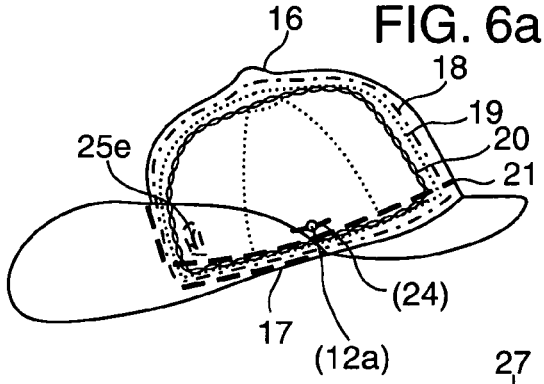
FIG. 6*a*: Shows one embodiment of protective sports hat insert device in operation, featuring a Western style of hat with the flexible inner shell and cloth liner.
Figure 6B:
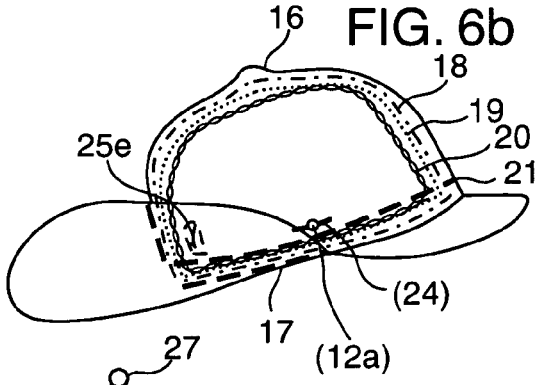
FIG. 6*b*: Shows one embodiment of a protective sports hat insert device in operation, featuring a Western style of hat with the rigid moulded inner shell and cloth liner.

Referring to FIGS. 2*a* and 2*b*, it can be seen that a choice of inner liner can be made using either the flexible foam or AMS of FIG. 2*a* to form the device featured in FIGS. 4*a*, 5*a*, 6*a* or the rigid hemispherical shell of expanded plastic of FIG. 2*b* to form the devices featured in FIGS. 4*b*, 5*b*, 6*b*.

The inner flexible circular and multi-wedge shaped section featured in FIG. 2*a* is folded into the inner side of the outer shell 1*a* (FIG. 1). Slits or holes 4*b* are punctured in the top of the wedge shaped sections or in the rigid inner shell to line up with the slits or holes 4*a* in the outer shell 1 to provide ventilation. Spacer strips 7*b* (FIG. 2*a,b*) are attached along the lower inner side of the inner shell to provide comfort, shock absorption, air ventilation and a better fit when the insert is worn. The inner shells have a tapered lower edge 7*a* (FIGS. 2*a,b*) to fit inside the hat to maintain the same outer appearance of the sports hat 15*a,aa,b,bb,c,cc* in FIGS. 4*a*–6*b* inclusive.

Figure 3A:
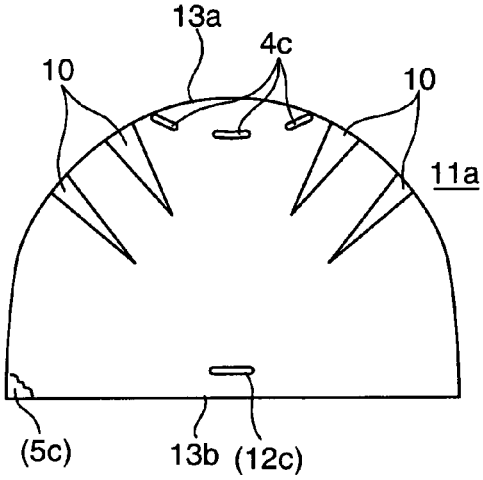
FIG. 3*a*: Shows one embodiment of an inner moisture absorbent layer of the cloth liner for the protective insert device.
Figure 3B:
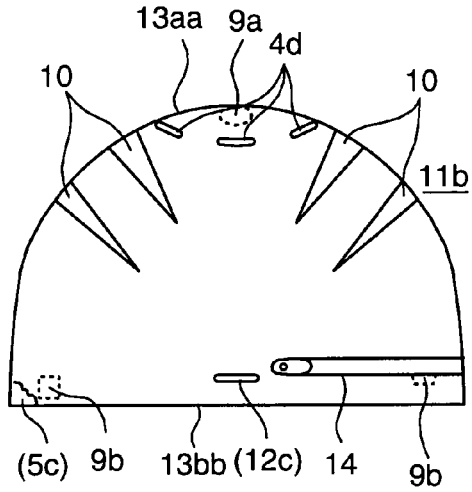
FIG. 3*b*: Shows one embodiment of an outer moisture resistant layer of the cloth liner for the protective insert device.
Figure 3C:
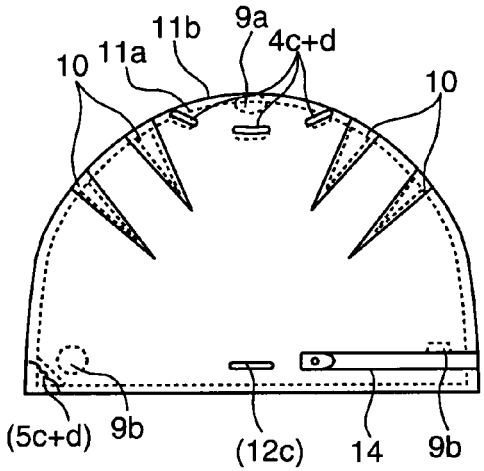
FIG. 3*c*: Shows one embodiment of a double layer cloth liner for the protective insert device.
Figure 3D:
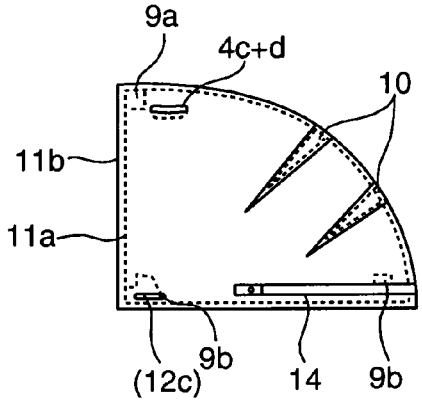
FIG. 3*d*: Shows one embodiment of a double layer cloth liner folded into a compact moisture resistant bag.
Figure 3E:
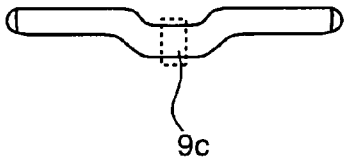
FIG. 3*e*: Shows one embodiment of a Velcro® attachment strip on a handlebar for attachment of the compact moisture resistant bag.

FIG. 3*a* illustrates an exemplary inner moisture absorbent layer 11*a* of a cloth liner. The top 13*a* of the liner ha is rounded in shape. A slit 12*c* is located near the bottom 13*b* of the liner 11*a*. FIG. 3*b* shows an exemplary outer moisture resistant layer 11*b* of the exemplary cloth liner. The top 13*aa* of the liner 11*b* is rounded in shape. A slit 12*c* is located near the bottom 13*bb* of the liner 11*b*. A zipper 14 is present in the outer resistant layer of the cloth liner 11*b*. FIG. 3*c* shows an exemplary double layer cloth liner which includes the inner layer 11*a* and outer layer 11*b*.

Referring to FIGS. 3*a*, 3*b*, & 3*c* it can be seen that the double layer cloth liner 11*a*&*b* has darts 10 sewn along the sides to shape it to fit inside the hemispherical shaped outer shell. The outer liner 11*b* can be secured by any method of attachment known to one skilled in the art, but preferably by the Velcro® smooth "loop" dot attachment 9*a*, 9*b* in FIG. 3*c* mating with the correspondingly mating Velcro® rough "hook" dot attachments 6*a*, 6*b* in FIGS. 2*a*, 2*b* to permit the cloth liner to be temporarily attached to the inner shell. If rough "hook" dots are attached to the interior of the insert, the smooth "loop" dots are optional as most cloth fabrics can be attached to the rough "hook" dots. Slits or holes in the form of buttonholes or the like along the top 4*c*, 4*d* line up to fit under the holes 4*a*, 4*b* in the inner and outer shells to provide ventilation. The removable liner may, in this way, be attached to any type of sports helmet, cap, hat, or the like to provide comfort and to act as a sweat absorber and it extends life to the hat. The double layer cloth layer can be folded quarterly or folded to a smaller size with the outer moisture resistant layer forming the exterior of a compact bag to be easily attached and carried as a spare liner to be exchanged as desired.

Figure 3F:
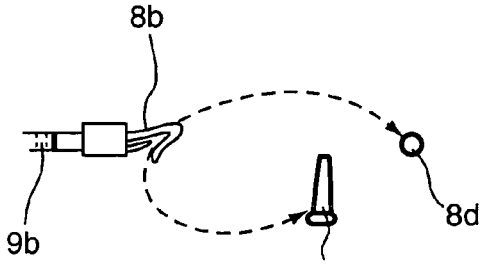
FIG. 3*f*: Shows one embodiment of a releasable clasp mechanism for attachment of the compact moisture resistant bag to a zipper or ring.

FIG. 3*f* shows an exemplary releasable clasp mechanism which includes a latch 8*b* which can be used to secure a ring 8*d* or zipper pull 8*c* that can be inserted into a hoop portion of the clasp mechanism.

Figure 7A:
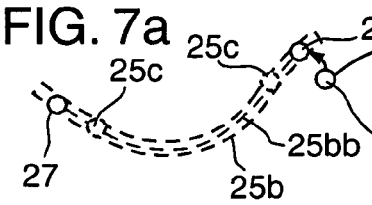
FIG. 7*a*: Shows one embodiment of a protective sports hat insert device featuring an optional cover or strip for the retention strap according to this invention for optional use in the first scenario.
Figure 7B:
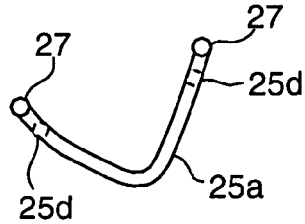
FIG. 7*b*: Shows one embodiment of a protective sports hat insert device featuring an optional retention strap and optional decorative snap cover according to this invention for optional use in the first scenario.
Figure 7C:
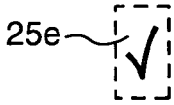
FIG. 7*c*: shows one embodiment of a protective sports hat insert device featuring a luminescent or highly legible decal to help identify the wearer for visual safety and as an identification symbol for law enforcement officers when a protective headgear is law.
Figure 8:
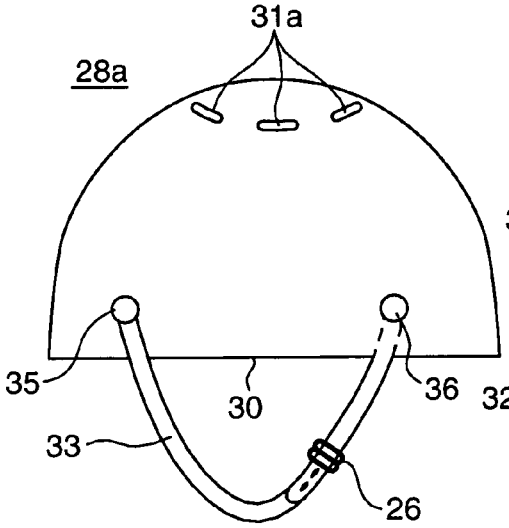
FIG. 8: Shows one embodiment of a protective sports hat insert device featuring the outer shell composed of a moulded compound of reinforced fibres or unreinforced plastic and a retention strap utilizing the permanent "rivet and mating snap" method according to this invention for use in the second scenario.
Figure 9:
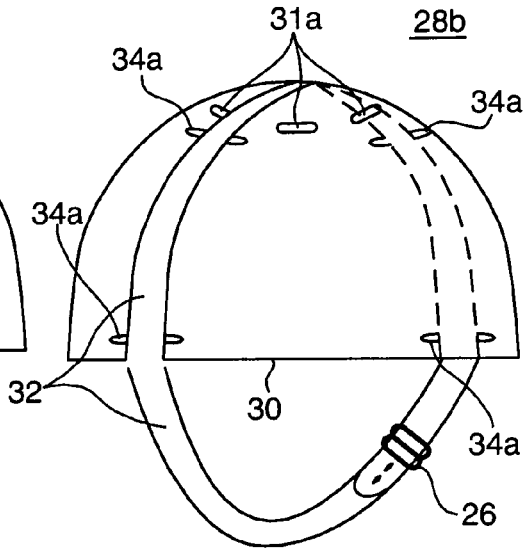
FIG. 9: Shows one embodiment of a protective sports hat insert device featuring the outer shell composed of a moulded compound of reinforced fibres or unreinforced plastic and a retention strap utilizing the "slits and loop-over-the-top" attachment method according to this invention in the second scenario.

Referring to FIGS. 7*a*& 7*b* it can be seen that a cloth retention cover 25*b* or cover strip 25*bb* in any desirable color pattern may be attached to the retention strap 25*a* or by attaching the mating Velcro® smooth "loop" dots 25*c* with its mating Velcro® rough "hook" dots 25*d* on the cloth retention cover. As with the cloth liner, if the material permits, the "loop" dots may be omitted if desired and the material may attach to the "hook" dots on its own. An optional decorative snap cover may be snapped over the original snap 27 as an aesthetic feature if desired. Referring to FIG. 7*c* the fluorescent or highly legible decal 25*e* may be attached to the back and/or front of the outer hats 25*e* to identify the wearer for visibility safety and as an identification feature for law enforcers in states or countries where the wearing of an approved headgear is law.

Referring to FIGS. 8, 12, 14, 16 the retention strap 33 is permanently attached by a rivet snap to the outer shell 35 at one end and is detachable by snap press-stud combination 36 at the other end of the retention strap. A tension buckle 26 allows the retention strap to be tightened or loosened to allow a perfect fit. As an option to fit the retention strap to the exterior of the hat, a buttonhole 36*a* can be added if desired.

Referring to FIGS. 9, 13, 15, 17 the retention strap 32 is attached through slits in the outer shell 34*a* and inner shell 34*b*. A tension buckle 26 allows the retention strap to be tightened or loosened to allow a perfect.

Figure 11:
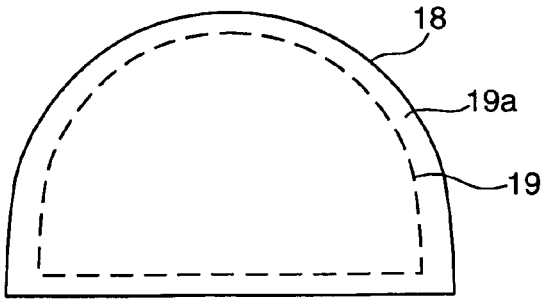
FIG. 11: Shows one embodiment of a protective sports hat insert device featuring an inner and outer shell according to this invention.
Figure 12:
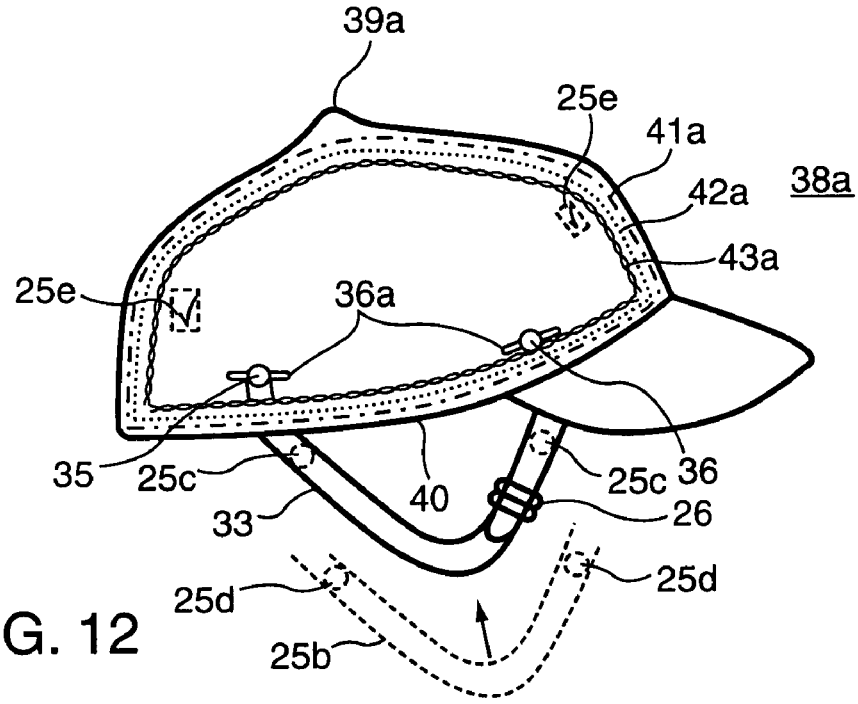
FIG. 12: Shows one embodiment of a protective sports hat insert device in operation featuring a fitted baseball cap style with the permanent "rivet and snap" method of retention strap according to this invention for use in the second scenario.
Figure 13:
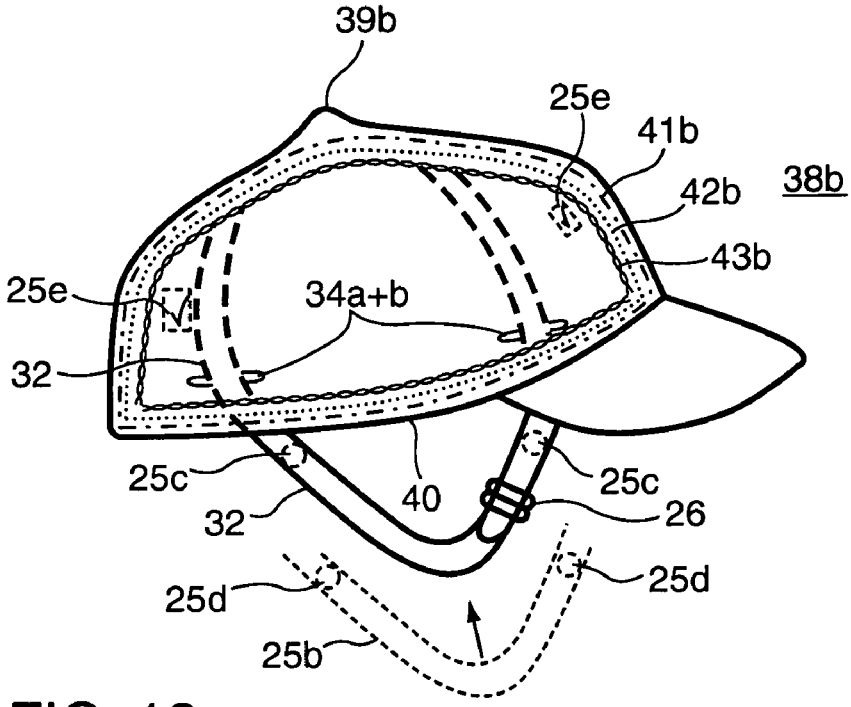
FIG. 13: Shows one embodiment of a protective sports hat insert device in operation featuring a fitted baseball cap style utilizing the "slit and loop-over-the-top" method of retention strap according to this invention for use in the second scenario.

Referring to FIG. 11, it can be seen that a layer of air 19*a* between the inner shell 18 and the outer shell 19 provides some shock absorption when the device receives a blow from an impact.

Figure 14:
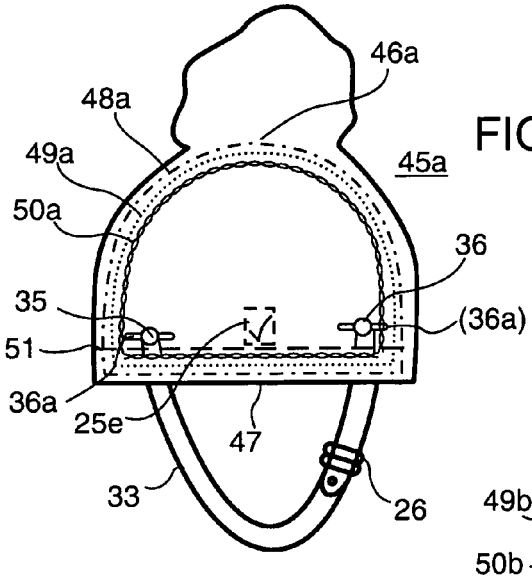
FIG. 14: Shows one embodiment of a protective sports hat insert device in operation featuring a winter ski hat style of hat with the permanent "rivet and snap" method of retention strap according to this invention for use in the second scenario.
Figure 15:
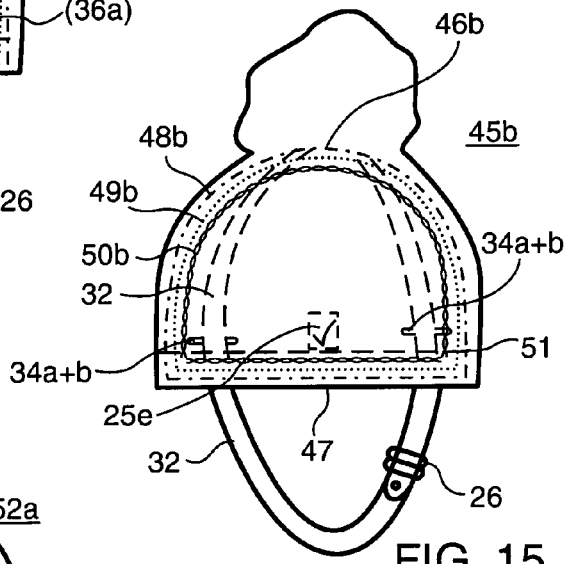
FIG. 15: Shows one embodiment of a protective sports hat insert device in operation featuring a winter ski hat style of hat with the "slit and loop-over-the-top" method of retention strap according to this invention for use in the second scenario.
Figure 16:
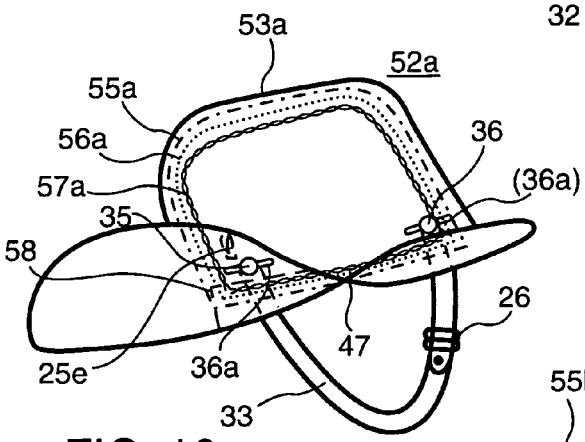
FIG. 16: Shows one embodiment of a protective sports hat insert device in operation featuring a western style of hat with the "rivet and snap" method of retention strap according to this invention for use in the second scenario.
Figure 17:
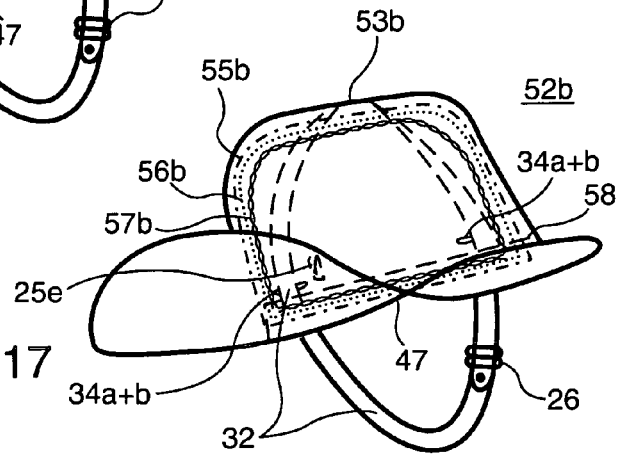
FIG. 17: Shows one embodiment of a protective sports hat insert device in operation featuring a western style of hat with the "slit and loop-over-the-top" method of retention strap according to this invention for use in the second scenario.

Referring to FIGS. 14, 15 it can be seen that the insert fits inside a winter style of hat 45*a*&b with the bottom of the outer winter hat 51 folded over to cover the ears and complement the outer appearance of the hat.

Figure 10:
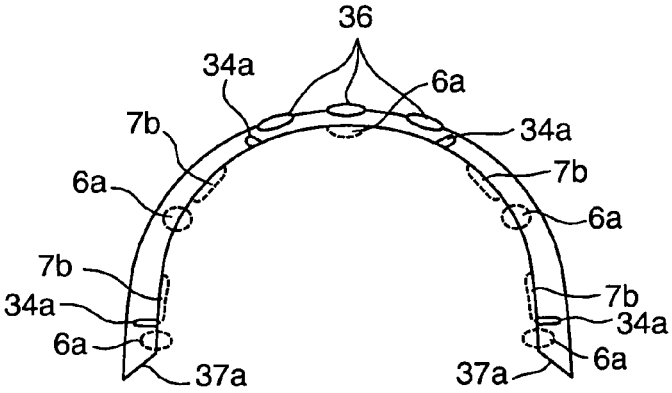
FIG. 10: Shows one embodiment of a protective sports hat insert device featuring an inner shell composed of rigid high-density foam, which tapers at the bottom edge according to this invention for use in the second scenario.

Referring to FIGS. 2*a*, 2*b* and FIG. 10 in particular, the lower bottom edge of the rigid inner liners are tapered 3*b* and 37*a* to allow the inner shell to fit inside the sports hat to maintain the perfect outward appearance of the regular sports hat 15*a, aa,b,bb,c,cc*; 38*a,b*; 45*a,b* and 52*a,b* as shown in FIGS. 4*a*–6*b* and 12–17 inclusive.

To insert the protective sports hat insert device for the first scenario, insert the outer compound shell 18 and inner foam liner 19 and its cloth liner 20 into hats: 15*a*, 15*aa*, 15*b*, 15*bb*, 15*c*, 15*cc* (FIGS. 4*a*–6*b*) with the top of the shell 2 (FIG. 1) fitting inside the top of the hat 16 and the bottom of the shell 3 tucked under the inner flap 21, which hold the outer shell 18 and the inner shell 19 and its cloth liner 20 firmly in place. A comfortable, lightweight protective insert is provided, while the outward appearance of the sports hat 15*a*, 15*aa*, 15*b*, 15*bb*, 15*c*, 15*cc* is maintained as shown in FIGS. 4*a*–6*b* inclusive.

To insert the protective sports hat insert device for use in the second scenario utilizing the "rivet and snap" retention strap method of attachment, insert the outer moulded shell 41*a*, 48*a*, 55*a* and the inner shell 42*a*, 49*a*, 56*a* into the hats 38*a*, 45*a*, 52*a* with the bottom of the insert 40, 47 encased under the inner flap 44, 47, 58 and in the winter hat style the bottom of the device 47 is pressed in by the folded section of the hat 51 to cover the device and the ears of the wearer for the warmth and to complement the other outer appearance of the hat. The outer shell 41*a*, 48*a*, 55*a* and the inner shell 42*a*, 49*a*, 56*a* with its cloth liner 43*a*, 50*a*, 57*a* when inserted inside the existing hat 38*a*, 45*a*, 52*a* provides comfortable lightweight protection while the outward appearance of the sports hat 38*a*, 45*a*, 52*a* is maintained.

To insert the protective sports hat insert device for use in the second scenario utilizing the "slit and loop" retention strap method of attachment, insert the outer moulded shell 41*b*, 48*b*, 55*b* and the inner shell 42*b*, 49*b*, 56*b* into the hats 38*b*, 45*b*, 52*b* with the bottom of the insert 40, 47 encased under the inner flap 44, 58 and in the winter hat style the bottom of the device 47 is pressed in by the folded section of the hat 51 to cover the device and the ears of the wearer for the warmth and to compliment the outer appearance of the hat. The outer shell 41*b*, 48*b*, 55*b* and the inner shell 42*b*, 49*b*, 56*b* with its cloth liner 43*b*, 50*b*, 57*b* when inserted inside the existing hat 38*b*, 45*b*, 52*b* provides comfortable lightweight protection while the outward appearance of the sports hat 38*b*, 45*b*, 52*b* is maintained.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A device for insertion into a hat comprising:

a hard outer shell sized for insertion into said hat and having a lower bottom edge;

an inner shell composed of an expanded high-density foamed material, said inner shell having an inside surface and an outside surface the inside surface tapering at a bottom edge, said tapering configured to angle towards said outside surface, a lower most point of the outside surface of the inner shell being substantially aligned with the bottom edge of the outer shell, the hard outer shell and soft inner shell being sized and shaped for insertion into the hat with both shells substantially covering an entire head area inside the hat.

2. The device of claim 1 wherein the outer shell comprises one or more layers of reinforced fibres such as aramid fibres or polyethylene fibres.

3. The device of claim 1 wherein the outer shell comprises rigid unreinforced plastic.

4. The device of claim 1 wherein the inner shell is composed of high-density foamed or expanded plastic such as EPS, HPDE, EPP, vinyl nitril or an Air Management System.

5. The device of claim 1 wherein spacers are provided on the inside of the inner foam shell.

6. The device of claim 1 including a removable retention strap.

7. The device of claim 6 including a snap connector on each end of the retention strap.

8. The device of claim 6 wherein a decorative cover or strip is attached to the retention strap as an aesthetic aid.

9. The device of claim 1 including a permanent retention strap.

10. The device of claim 1 including a luminescent or highly legible emblem decal with an approval symbol.

11. The device of claim 1 wherein slits or holes are punctured along the top of the outer shell, which align with matching slits or holes in the inner shell to provide ventilation.

12. The device of claim 1, further comprising:

a removable double layer cloth liner comprising: an inner layer of moisture absorbent material to be against a head and backed by an outer layer of moisture resistant material to be placed against the inner shell with both layers substantially covering the entire head area inside the hat.

13. The device of claim 12 wherein a double-layer removable moisture absorbent and moisture resistant cloth liner is attached to the inside of the inner shell.

14. The device of claim 12 wherein the inner layer of the cloth liner is composed of a washable moisture absorbent material to absorb sweat and add comfort.

15. The device of claim 12 wherein the outer layer of the cloth liner is composed of a washable moisture resistant material.

16. The device of claim 12 wherein the means of temporary attachment includes a mating hook and loop fastener.

17. A device for insertion into a hat, the device comprising:

a hard outer shell sized for insertion into said hat and having a lower bottom edge; and an inner shell located inside said hard outer shell, said inner shell being composed of an energy absorbing material, said inner shell having an inside surface and an outside surface the inside surface tapering at a bottom edge, said tapering configured to angle towards said outside surface, a lower most point of the outside surface of the inner shell being substantially aligned with the bottom edge of the outer shell.

18. A hat assembly comprising:

a hat;

a hard outer shell having a lower bottom edge located inside said outer hat; and an inner shell located inside said hard outer shell, said inner shell being composed of an energy absorbing material, said inner shell having an inside surface and an outside surface the inside surface tapering at a bottom edge, said tapering configured to angle towards said outside surface, a lower most point of the outside surface of the inner shell being substantially aligned with the bottom edge of the outer shell, the hard outer shell and inner shell being sized and shaped for insertion into said hat with both shells substantially covering an entire head area inside the inner shell; and wherein said hat includes a flap, said flap covering the bottom edge of the hard outer shell and inner shell.

19. The hat assembly of claim 18, wherein said hat is a cap.

20. A hat assembly comprising:

a hat;

a hard outer shell having a lower bottom edge; an inner shell composed of an expanded high-density foamed material, said inner shell having an inside surface and an outside surface the inside surface tapering at a bottom eoge, said tapering configured to angle towards said outside surface, a lower most point of the outside surface of the inner shell being substantially aligned with the bottom edge of the outer shell, the hard outer shell and soft inner shell being sized and shaped for insertion into the hat with both shells substantially covering an entire head area inside the hat; and wherein said hat includes a flap, said flap covering the bottom edge of the hard outer shell and soft inner shell.

21. The hat assembly of claim 20, wherein said hat is a sports cap.

22. The hat assembly of claim 20, further comprising:

a removable cloth liner including a moisture absorbent material.

23. The hat assembly of claim 21, further comprising:

a removable cloth liner including a moisture absorbent material.

* * * * *